US008800118B2

(12) United States Patent
Takasawa et al.

(10) Patent No.: US 8,800,118 B2
(45) Date of Patent: Aug. 12, 2014

(54) READILY BURSTABLE SLIDE FASTENER

(75) Inventors: Shigeyoshi Takasawa, Runcorn (GB); Shunji Akashi, Kurobe (JP); Mark Davies, Runcorn (GB)

(73) Assignee: YKK Corporation

( * ) Notice: Subject to any disclaimer, the term of this patent is extended or adjusted under 35 U.S.C. 154(b) by 1001 days.

(21) Appl. No.: 11/887,533

(22) PCT Filed: Mar. 31, 2006

(86) PCT No.: PCT/GB2006/001161

§ 371 (c)(1),
(2), (4) Date: Aug. 12, 2008

(87) PCT Pub. No.: WO2006/103438

PCT Pub. Date: Oct. 5, 2006

(65) Prior Publication Data

US 2009/0049658 A1 Feb. 26, 2009

(30) Foreign Application Priority Data

Apr. 1, 2005 (GB) ..... 0506680.8
Oct. 21, 2005 (GB) ..... 0521494.5

(51) Int. Cl.
*A44B 19/16* (2006.01)
*A44B 19/38* (2006.01)

(52) U.S. Cl.
USPC ..... 24/401; 24/404; 24/434; 24/436

(58) Field of Classification Search
USPC ..... 24/401, 402–404, 406, 408–413, 591.1, 24/387, 388, 433, 436, 434
See application file for complete search history.

(56) References Cited

U.S. PATENT DOCUMENTS 2,422,091 A * 6/1947 Gould ..... 24/436
2,625,726 A 1/1953 Austin
2,875,490 A 3/1959 Sinclair
3,122,808 A 3/1964 Maschi et al.

(Continued)

FOREIGN PATENT DOCUMENTS

EP 1 468 622 A1 10/2004
EP 1 611 812 A 1/2006

(Continued)

OTHER PUBLICATIONS

Office Action dated Aug. 7, 2008 for corresponding European Application No. 06 726 568.6-2314.

(Continued)

*Primary Examiner* — Robert J Sandy
*Assistant Examiner* — Rowland Do
(74) *Attorney, Agent, or Firm* — Alston & Bird LLP

(57) ABSTRACT

A readily burstable slide fastener for an inflatable device, such as a lifejacket, that includes a first stringer, a second stringer and a slider slidably mounted on the second stringer. At a weakened region along the slide fastener coupling elements are omitted from each of the stringers so that when a bursting force is applied to this region the coupling elements adjacent thereto are disengaged. The coupling elements are omitted from the top of the first stringer so that when the slider is at the top of the coupling elements of the second stringer, the first stringer can disengage from the slider. When the slide fastener is fitted to an inflatable lifejacket, the stringers are separated completely when the lifejacket is inflated.

5 Claims, 14 Drawing Sheets

(56) References Cited

U.S. PATENT DOCUMENTS

| | | | | | |
|---|---|---|---|---|---|
| 3,289,264 | A | | 12/1966 | Doelter | |
| 3,731,349 | A | | 5/1973 | Terada | |
| 3,977,051 | A | | 8/1976 | Takamatsu | |
| 4,000,545 | A | | 1/1977 | Takamatsu | |
| 4,023,241 | A | | 5/1977 | Kanzaka | |
| 4,667,377 | A | * | 5/1987 | Akashi et al. | 24/436 |
| 4,878,275 | A | * | 11/1989 | Kazui et al. | 24/436 |
| 5,400,482 | A | * | 3/1995 | Oda | 24/433 |
| 5,443,535 | A | * | 8/1995 | Oda | 29/408 |
| 5,860,193 | A | * | 1/1999 | Wang | 24/436 |
| 6,070,306 | A | * | 6/2000 | Wang | 24/436 |
| 6,327,755 | B1 | * | 12/2001 | Wang | 24/436 |
| 6,715,187 | B1 | * | 4/2004 | Wang | 24/436 |
| 6,832,415 | B2 | * | 12/2004 | Higginbotham et al. | 24/399 |
| 2004/0187277 | A1 | | 9/2004 | Akashi et al. | |
| 2005/0060847 | A1 | * | 3/2005 | Himi et al. | 24/388 |
| 2005/0060848 | A1 | * | 3/2005 | Tsaur | 24/436 |
| 2006/0000065 | A1 | | 1/2006 | Takasawa et al. | |

FOREIGN PATENT DOCUMENTS

| | | | |
|---|---|---|---|
| GB | 678 755 | A | 9/1952 |
| GB | 1 480 176 | A | 7/1977 |
| GB | 1 514 296 | | 6/1978 |
| JP | 08-173215 | A | 7/1996 |
| WO | WO 2006/047655 | A | 5/2006 |

OTHER PUBLICATIONS

Search Report dated Apr. 26, 2006 for corresponding United Kingdom Patent Application No. GB0521494.5.

International Search Report of Application No. PCT/GB2006/001161, dated Aug. 1, 2006.

European Search Report for EP Application No. 09 00 3934 dated Apr. 7, 2010.

United States Patent and Trademark Office, Office Action for U.S. Appl. No. 13/243,424, dated Aug. 15, 2012, 8 pages, USA.

United States Patent and Trademark Office, Office Action for U.S. Appl. No. 13/243,424, dated May 8, 2013, 10 pages, USA.

* cited by examiner

READILY BURSTABLE SLIDE FASTENER

This invention relates to a readily burstable slide fastener. In particular it relates to a readily burstable slide fastener for an inflatable device, such as a lifejacket or liferaft, and to an inflatable device including a readily burstable slide fastener.

Lifejackets are worn in a number of applications, to provide buoyancy to the person who is wearing the lifejacket. For example, a lifejacket may be worn by a person engaged in water sports or by a person travelling by sea, either for the duration of the journey or in the event of an emergency. The buoyancy of a lifejacket is provided by a material of low density, such as pockets of air or blocks of expanded polystyrene. For a lifejacket to provide sufficient buoyancy, the lifejacket needs to contain a sufficient volume of buoyant material which inevitably makes the lifejacket bulky. This bulkiness can hinder movement of the person wearing the lifejacket. Therefore, it is common to use inflatable lifejackets which are compact when deflated and which can be inflated when required. Similarly, it is known to provide inflatable liferafts which can be stored on-deck and inflated as they are thrown overboard.

An example of an inflatable lifejacket is shown in FIG. 1. The lifejacket 101 comprises a fabric outer skin 103 and an inner inflatable tube 105. The fabric outer skin 103 is folded to form a front panel 107 and a back panel 109 which are detachably joined around the outer peripheral edge 111 of the lifejacket 101 by a hook-and-loop surface fastener 113, 115 (see insert). This forms a compact, relatively thin article which can be worn without hindering the movement of the user.

When the lifejacket 101 is deployed, a canister of compressed gas (not shown) is triggered by pulling a cord 117 to inflate the inner tube 105 of the lifejacket 101. As the inner tube 105 inflates, it pushes against the front panel 107 and the back panel 109 of the outer skin 103, to force open the surface fastener 113, 115 which runs around the peripheral edge 111 of the lifejacket 101. After a few seconds the inner tube 105 is fully inflated, the surface fastener 113, 115 is open all the way along its length and the inflated inner tube 105 projects beyond the peripheral edge 111 of the lifejacket 101.

A disadvantage of using a hook-and-loop surface fastener to detachably join the front panel 107 and back panel 109 of the outer skin 103 is that each time the inner tube 105 is inflated and the hook-and-loop surface fastener 113, 115 is separated, the adhesive force between the two surface fasteners 113, 115 decreases as a result of wear and tear on the hooks and loops. Furthermore, as such lifejackets 101 are generally used in a marine environment, the hook-and-loop surface fastener often come into contact with water which can degrade the materials from which the surface fastener is made, thereby reducing the effectiveness of the hook-and-loop surface fastener over an extended period of time, requiring periodic replacement of the surface fastener.

A further disadvantage of using a surface fastener for this application is the danger which may occur when such lifejackets are used in freezing conditions where there is a possibility that water, which has sprayed onto the lifejacket, may freeze. If water freezes in the join of the surface fastener then this will prevent separation of the two surfaces. These disadvantages can be overcome if the hook-and-loop surface fastener is replaced by a slide fastener, such as a zip fastener. However, the surface fastener cannot be simply replaced by a conventional slide fastener, as conventional slide fasteners cannot be burst open at a point along their length, unlike the way in which the surface fastener operates in a lifejacket.

According to a first aspect of the invention there is provided an inflatable device comprising an inflatable member and a covering, the covering being secured around the deflated inflatable member by a readily burstable slide fastener. Preferably the slide fastener opens automatically fully along its length under the force of the inflating member.

The device could be an inflatable lifejacket, a liferaft, an inflatable bed, a personal protective device for protecting the hips and other body parts, and the like.

Another aspect of the present invention provides a readily burstable slide fastener comprising a first stringer, a second stringer and a slider, each stringer being comprised of a tape and first coupling elements mounted on an edge of the tape, the slider being slidably mounted on the second stringer and slidable along the coupling elements of the first and second stringers to engage the coupling elements as it moves from a bottom of the slide fastener to a top of the slide fastener, wherein at a first position along the slide fastener one or both of the stringers are adapted so that when a bursting force is applied at the first position in a first direction substantially perpendicular to the plane in which the coupling elements lie at the first position, coupling elements adjacent to the first position are disengaged.

Other aspects and preferred features of the invention will be apparent from the following description and the accompanying drawings.

The invention will now be further described by way of example with reference to the accompanying drawings in which.

Figure 2:
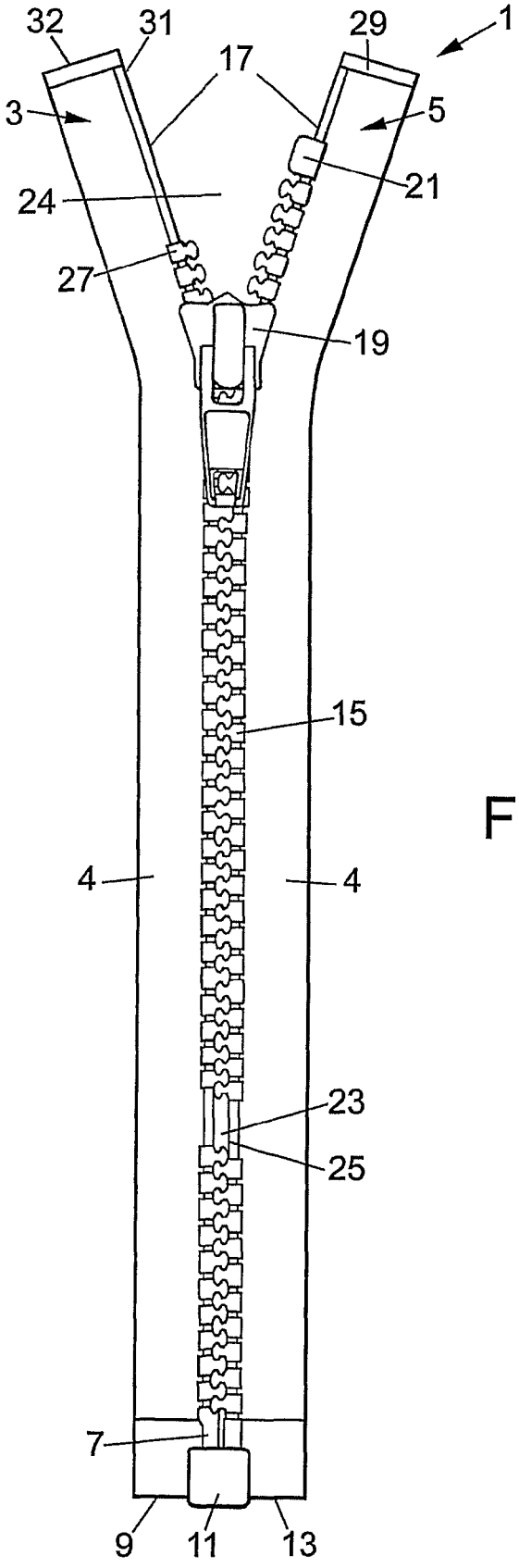
FIG. 2 shows a slide fastener according to a first embodiment of this invention.
Figure 3:
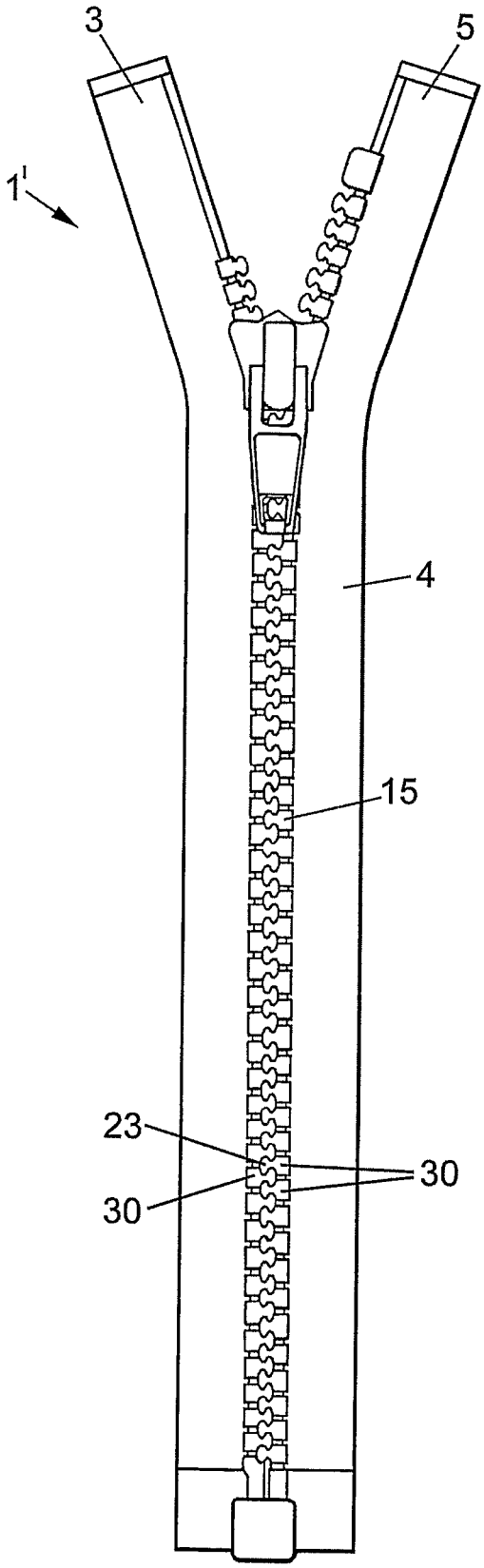
FIG. 3 shows a slide fastener according to a second embodiment of this invention.
Figure 4A:
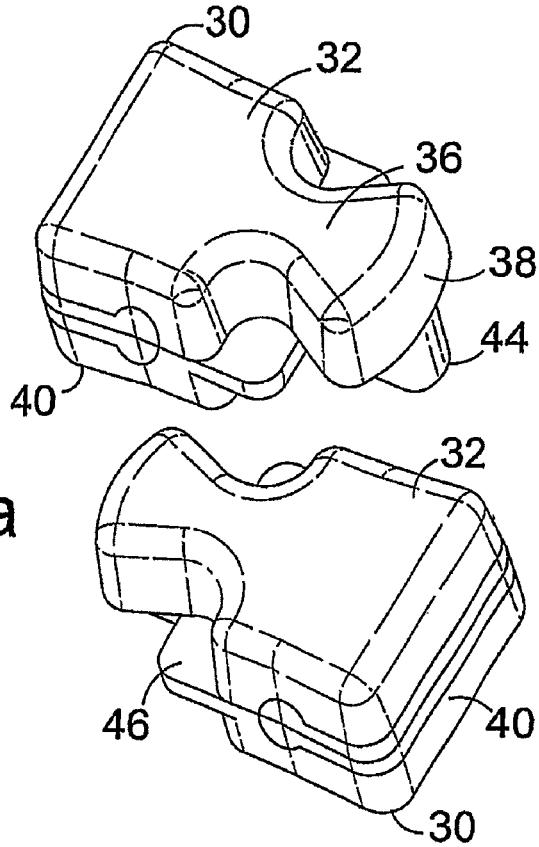
Figure 4B:
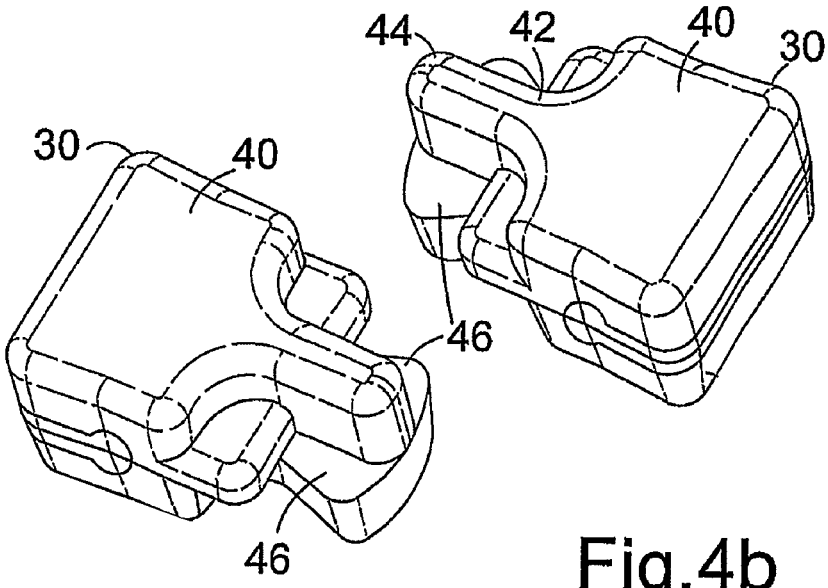
Figure 5:
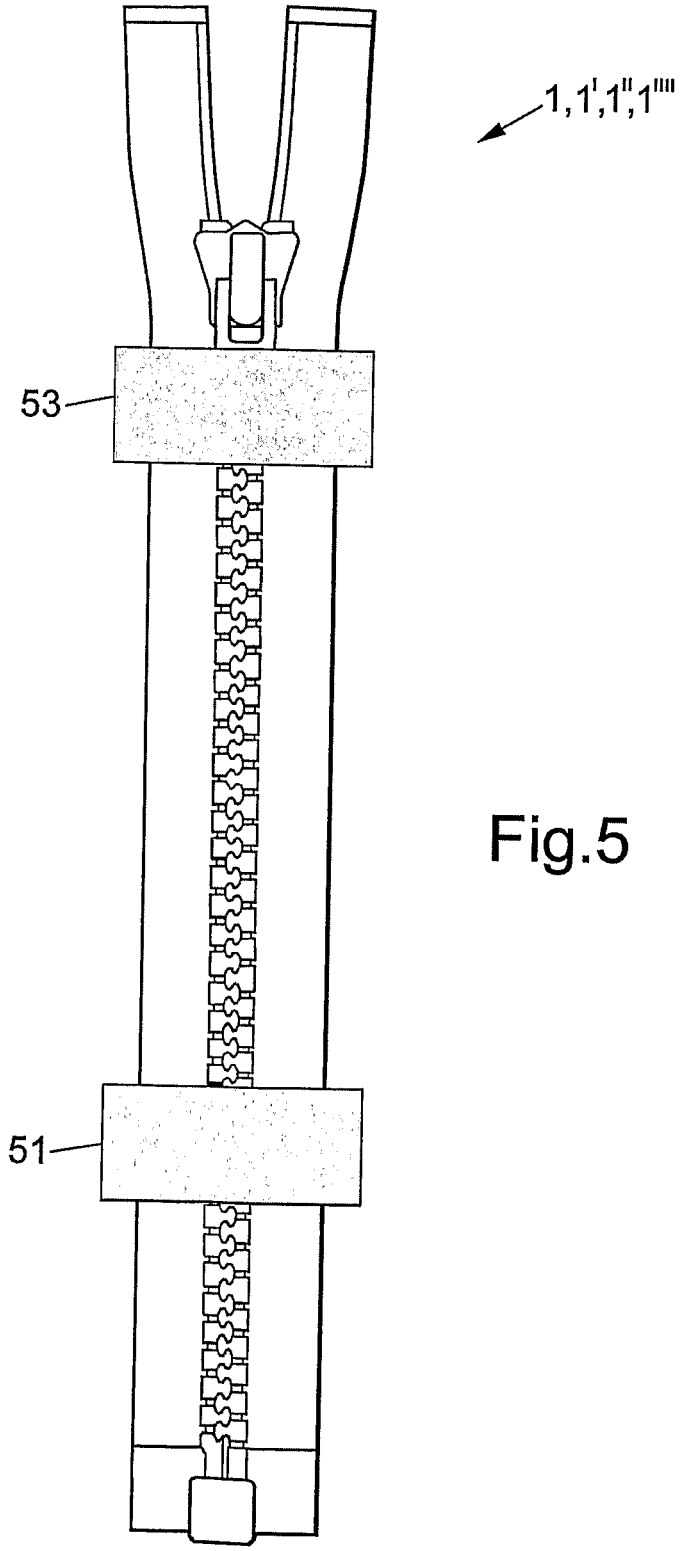
Figure 6:
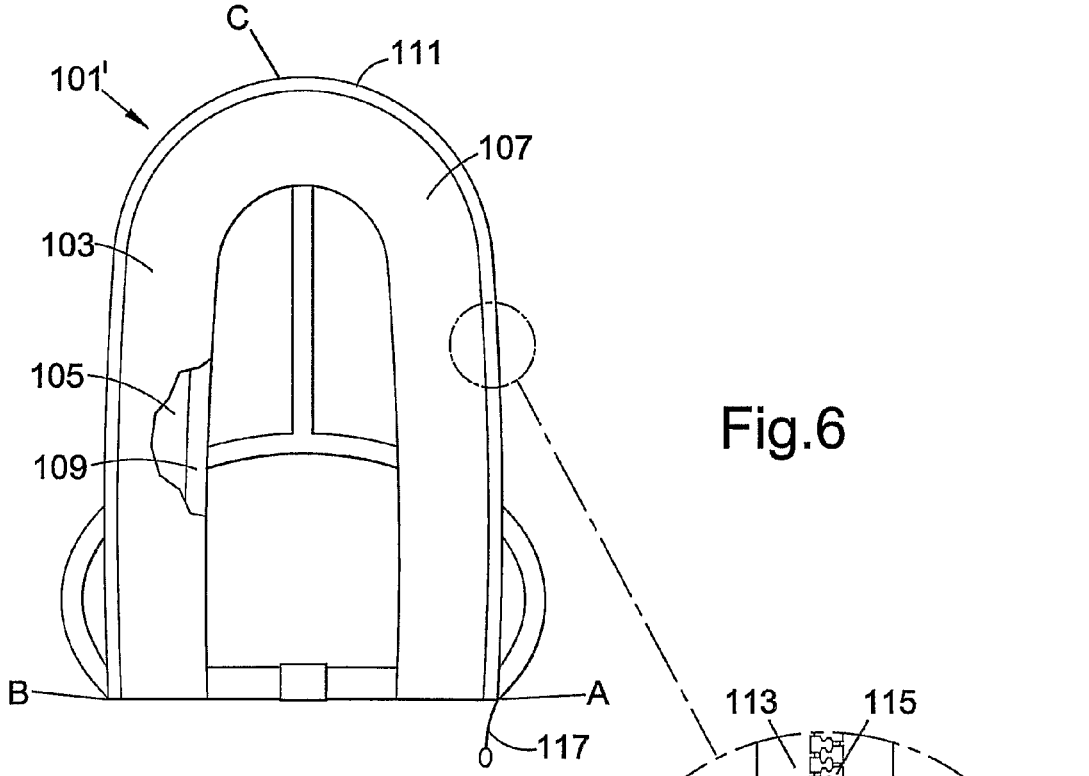
Figure 7:
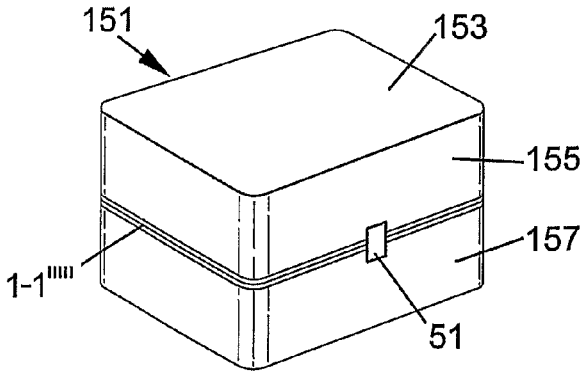
Figure 8:
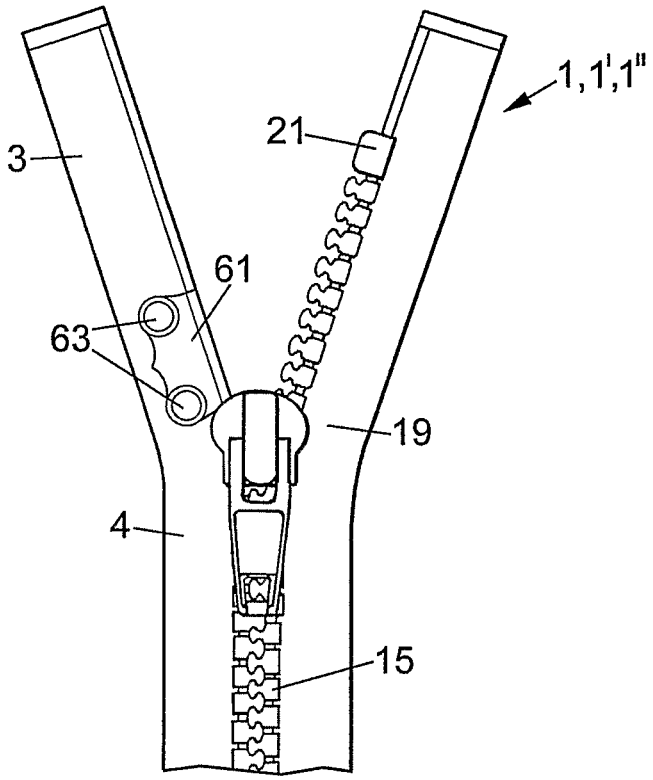
Figure 9:
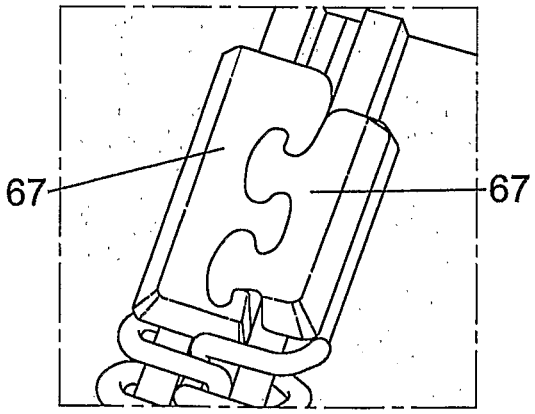
Figure 10:
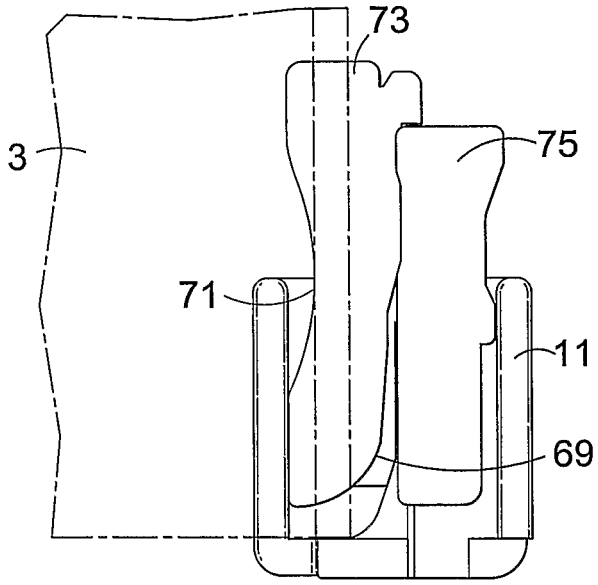
Figure 11:
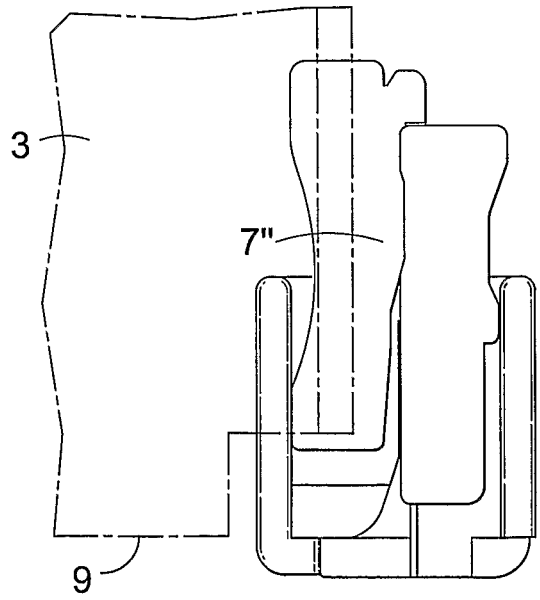
Figure 12:
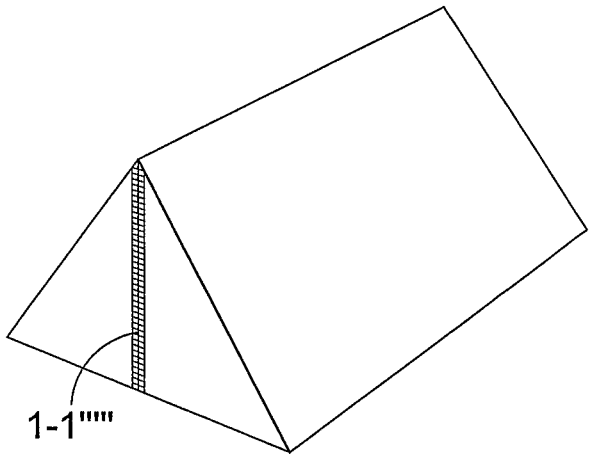
Figure 13:
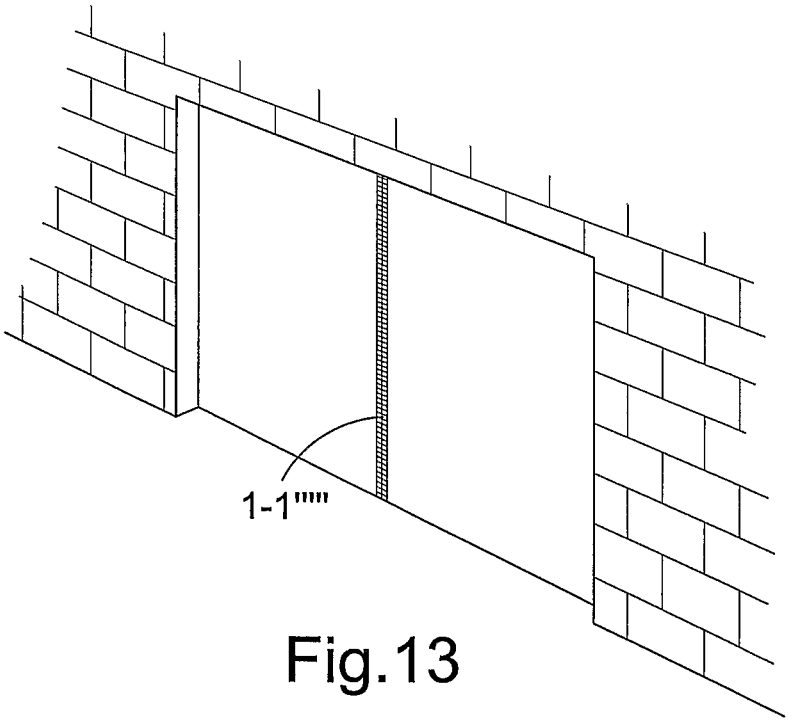
Figure 14:
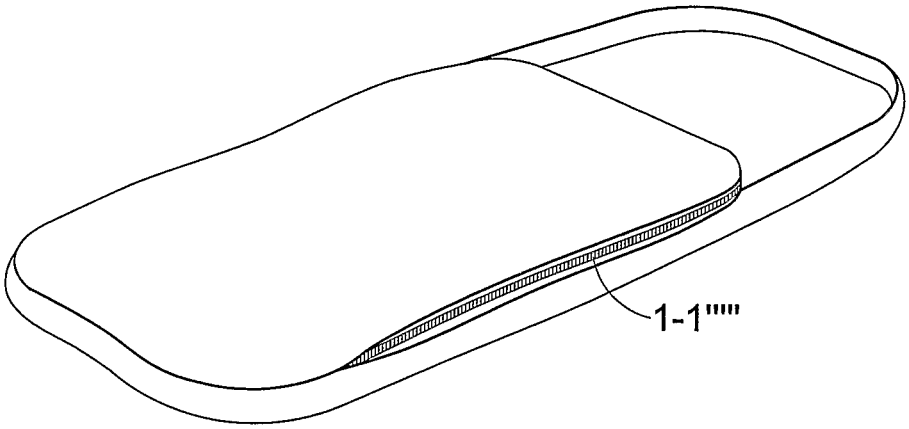
Figure 15:
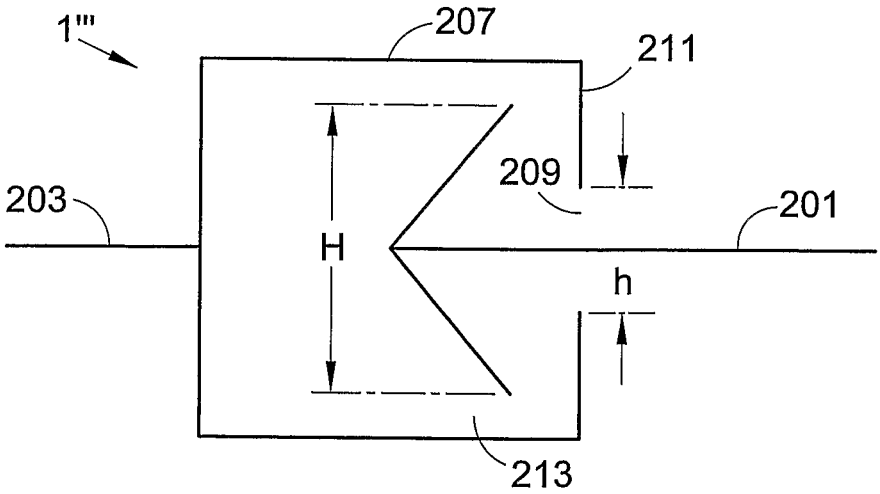
Figure 16:
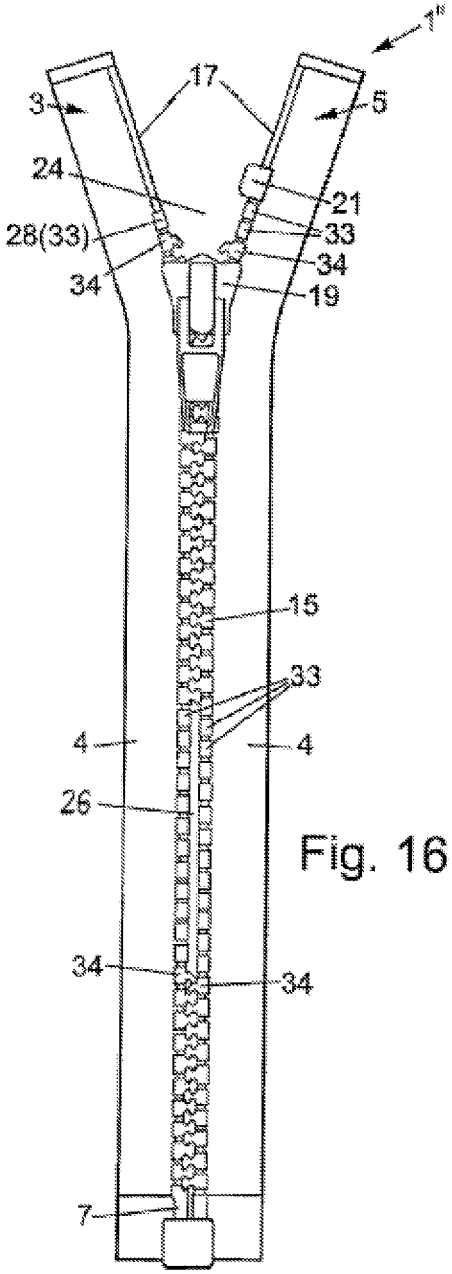
Figure 17:
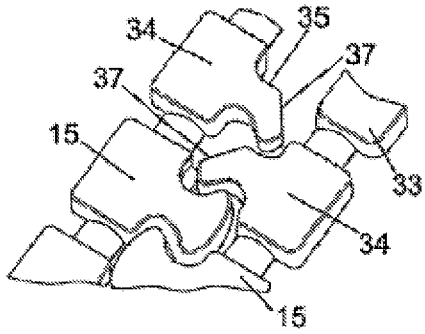
Figure 17A:
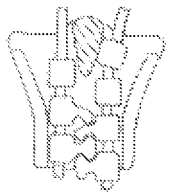
Figure 17B:
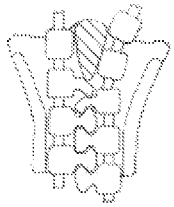
Figure 17C:
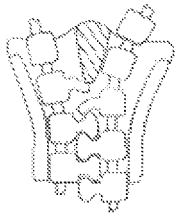
Figure 17D:
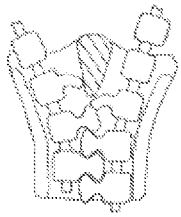
Figure 18:
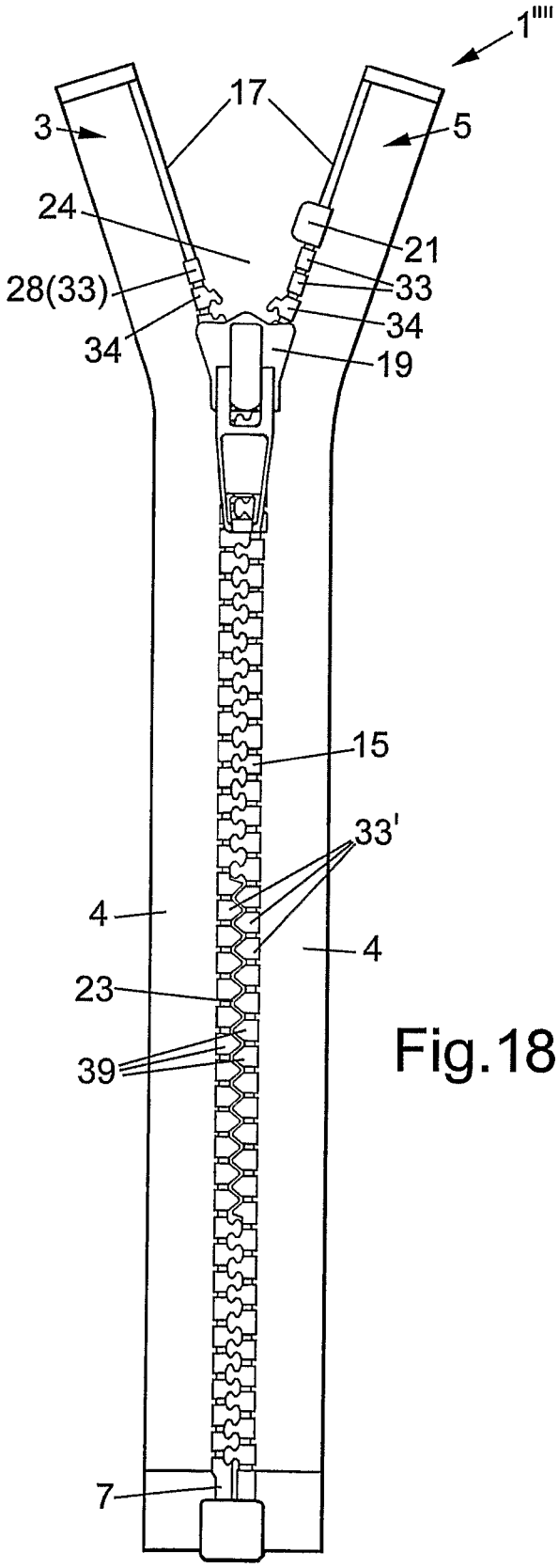
Figure 19:
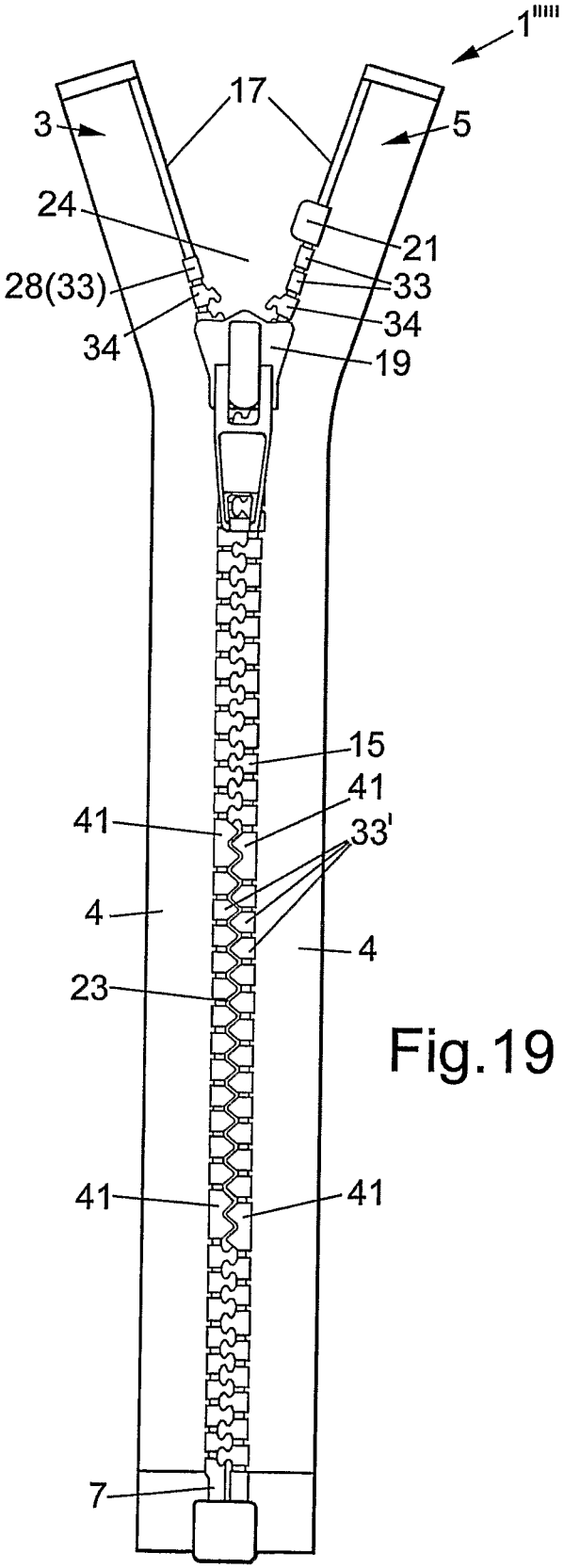
Figure 20:
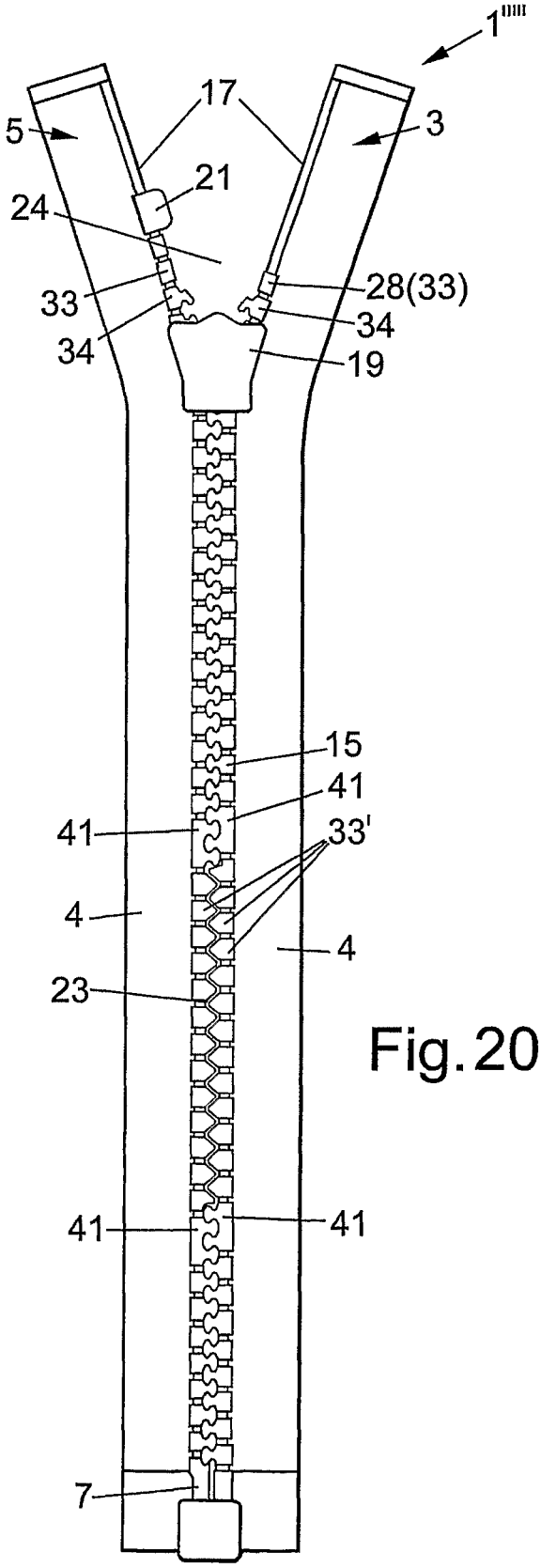

FIGS. 4*a* and 4*b* are perspective views of pairs of modified coupling elements which form part of the slide fastener of FIG. 3;

FIG. 5 shows a slide fastener according to a third embodiment of the invention;

FIG. 6 shows an inflatable lifejacket including the slide fastener of FIG. 2;

FIG. 7 shows an inflatable liferaft including the slide fastener of FIG. 2, 3, 5, 15 or 16;

FIG. 8 shows a temporary end stop to be used at the upper end of the slide fastener of FIG. 2, 3, 5 or 16;

FIG. 9 shows locking coupling elements to be used on the slide fastener of FIG. 2, 3, 5 or 16; and FIGS. 10 and 11 show modified insert pins for use on the slide fastener of the FIG. 2, 3, 5 or 16;

FIGS. 12, 13 and 14 show embodiments of the invention incorporating a slide fastener of the invention;

FIG. 15 is a schematic cross sectional view of a second type of slide fastener according to a further embodiment of the invention;

FIG. 16 shows a slide fastener according to a further embodiment of this invention; and FIG. 17 is a perspective view of the modified elements of the slide fastener of FIG. 16; and FIGS. 17*a*-17*d* show the slider coming into contact with the transition element; and FIG. 18 shows a slide fastener according to a further embodiment of this invention; and FIG. 19 shows a slide fastener according to a further embodiment of this invention; and FIG. 20 is a rear view of the slide fastener of FIG. 19.

FIG. 2 shows a slide fastener 1 according to a first embodiment of the invention. The slide fastener 1 is comprised of a first stringer 3, a second stringer 5 and a slider 19. Each stringer 3, 5 is comprised of a tape 4 and coupling elements 15. The coupling elements 15 are mounted on opposing edges 17 of each tape 4. There is an insert pin 7 mounted at the lower end 9 of the first stringer 3, adjacent the coupling elements 15, which fits into a retaining box 11 mounted at a lower end 13, of the second stringer 5, adjacent the coupling elements 15. The slider 19 is slidably mounted on the coupling elements 15 of the second stringer 5. The slider 19 can slide along the coupling elements 15 between the retaining box 11 at the bottom end of the coupling elements 15 and an end stop 21 at the top end of the coupling elements 15. When the slider 19 is adjacent the retaining box 11, the insert pin 7 is inserted through the slider 19 into the retaining box 11 and the slider 19 can move along both sets of coupling elements 15 to engage opposing coupling elements 15. The construction thus far described is well known in the art of slide or zip fasteners.

At a first position there is a weakened region 26 along the length of the slide fastener 1, two coupling elements 15 have been removed from each of the stringers 3, 5 to leave a gap 25 between adjacent coupling elements 15 of the slide fastener 1.

The gap 25 serves as a weak point along the length of the slide fastener 1. A conventional slide fastener is able to withstand forces which are applied in a direction perpendicular to the plane in which the tapes lie. When such a force is applied, opposed coupling elements remain engaged and the slide fastener does not burst, unless a strong force is applied. However, for the slide fastener 1 of this invention, if a force is applied to the slide fastener 1 at the first position 23 in a direction perpendicular to the plane of the fastener, in particular the plane in which the elements 15 lie, the coupling elements 15 adjacent to the gap 25 are unable to withstand the force and these coupling elements 15 will disengage and the slide fastener will begin to unpeel along the length of the slide fastener 1.

On the first stringer 3, a number of coupling elements 15 have been removed from the top end of the coupling elements 15 distal to the insert pin 7 to fully expose the cord 31 on the edge 17 of the tape 4, so that the overall length of the coupling elements 15 on the first stringer 3 is less than the overall length of the coupling elements 15 on the second stringer 5. Put another way, the coupling elements 15 and end stop 21 of the second stringer 5 extend beyond the coupling elements 15 of the first stringer 3. Preferably the number of coupling elements 15 removed from the first stringer 3 is such that when the slider 19 is at its uppermost position on the second stringer 5, abutting the end stop 21, part of the top coupling element 27 on the first stringer 3 is disposed in the slider 19. The presence of this top coupling element 27 in the slider 19 prevents separation of the stringers 3, 5 at this position when the slide fastener 1 is closed with the slider 19 against the end stop 21. This arrangement does not, however, prevent separation of the stringers 3, 5 when the slide fastener bursts open, and may also provide a weakened region for bursting of the slide fastener as is explained below.

As known in the art, there is a slit (not shown) in the side of the slider 19 through which the tape 4 passes in normal use. The height of the cord 31 is greater than the height of the slit, so that when the slider 19 is at its uppermost position, the cord 31 cannot move freely sideways out of the slider 19. However, the cord 31 is not so high such that the cord 31 cannot be pulled out of the slider 19 if a reasonable force is applied.

The coupling elements 15 of this slide fastener 1 are moulded plastic elements of the VISLON (trade mark) type marketed by the applicant. However, other coupling elements such as metal or coil elements may be used in place of this type of element.

Figure 1:
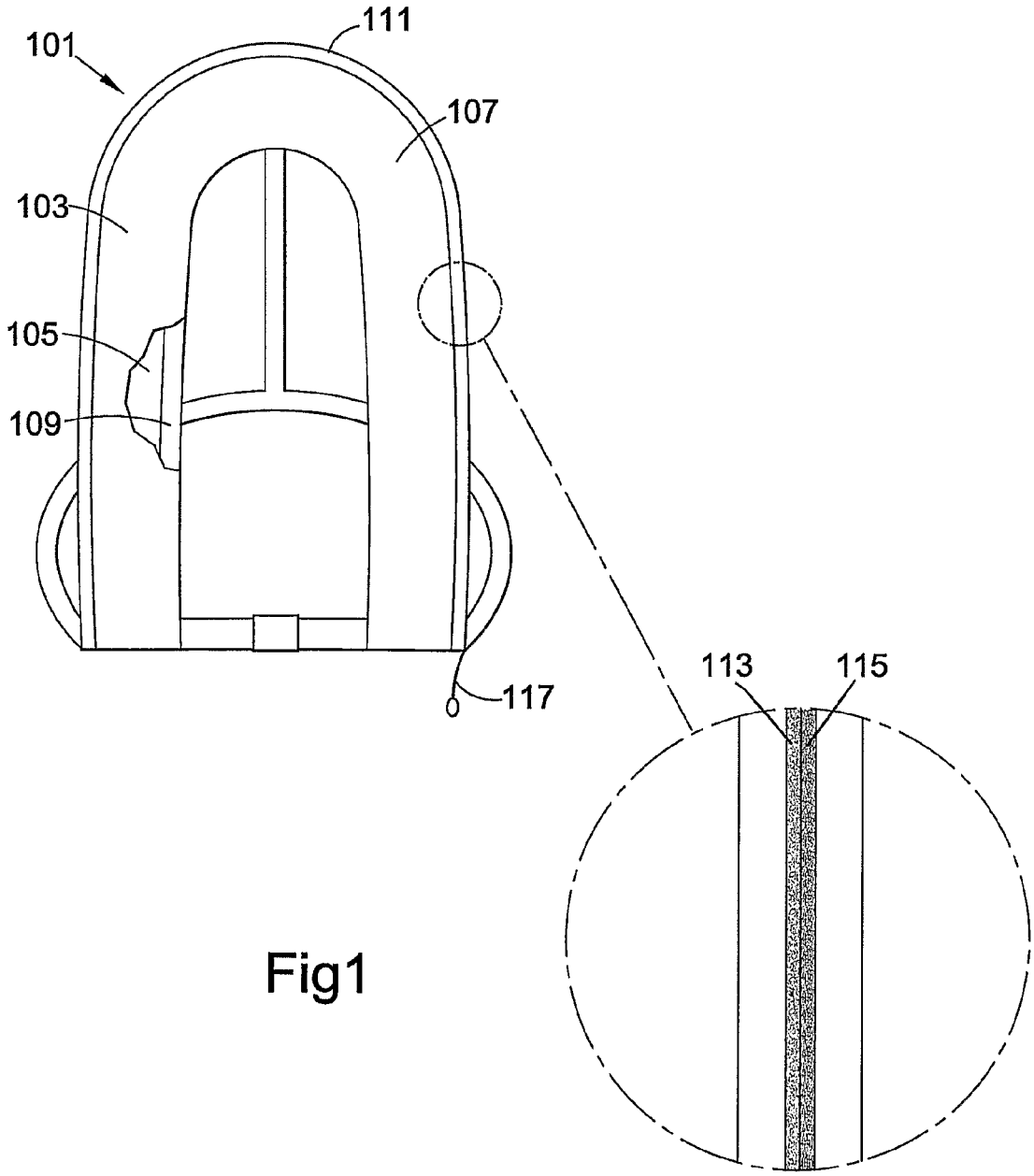
FIG. 1 shows a known partially cut-away inflatable lifejacket.

The slide fastener 1 is fitted to the outer peripheral edge 111 of a lifejacket, as shown in FIG. 6, to replace the surface fastener which is shown in FIG. 1. Each of the stringers 3, 5 is sewn or welded to one of the opposing edges of the front panel 107 and back panel 109. The fastener extends almost completely around the peripheral edge 111, from points A to B shown in FIG. 6. Thus the bottom end 9, 13 of the slide fastener tapes 4, will be at point A and the upper ends 29, 32 of the tapes 4, at point B (or vice versa). The slide fastener 1 can be attached to the covering of other inflatable devices in a similar manner as will be described further by way of example hereinafter.

In use, the slider 19 is moved to the bottom end 13 of the second stringer 5 so that the slider 19 abuts the retaining box 11. The insert pin 7 is inserted through the slider 19 into the retaining box 11. The slider 19 is translated along the slide fastener 1 to the upper end 29 of the slide fastener 1, thereby engaging opposing coupling elements 15 as it moves along the slide fastener 1. As the slider 19 moves over the gap 25, the slider 19 continues to engage opposing coupling elements 15 beyond the gap 25. Once the slider 19 has traveled to the top end 29 of the slide fastener 1, all opposing coupling elements 15 will be engaged and the slider 19 will be at its uppermost position, at the end stop 21 of the second stringer 5. At this position, there are no engaging elements 15 on the edge 17 of the first stringer 3, and the cord 31, which is attached to the edge 17 of the first stringer 3, is located within the slider 19. As the height of the cord 31 is greater than the height of the slit, the cord 31 does not move freely sideways out of the slider 19, but will slip out when a predetermined force is applied. If part of the top coupling element 17 on the first stringer 3 is disposed in the slider 19, this top coupling element 17 serves to prevent separation of the stringers 3, 5. In other embodiments the cord 31 may be thinned so that the slider 19 can move freely out of the slider 19 or there may be no cord.

When the lifejacket 101' of FIG. 6 is inflated, as the inflatable tube expands, it exerts a force on the slide fastener 1 in a direction substantially perpendicular to the plane in which the tape elements 15 lie. When this force is exerted at the first weakened region 26 where there is a gap 25 in the coupling elements, those coupling elements 15 adjacent to the gap 25 in the slide fastener 1 will be pushed outwards and will disengage from each other, the remaining coupling elements 15 of the slide fastener 1 peeling apart all the way to the ends 9, 13, 29 of the slide fastener 1. Once the engaging elements 15 of the slide fastener have opened at the top 29 of the slide fastener 1, the cord 31 is forced out of the slider 19. For the alternative embodiment mentioned above having a thinned cord, the cord will slip out of the slider 19. If, as mentioned above, part of the top coupling element 27 on the first stringer 3 is disposed in the slider 19, this top coupling element 27 is pulled out of the slider 19 before the cord 31 is forced out of the slider 19.

In this manner, the slide fastener 1 will open fully along its length when the inner tube of the lifejacket (or other inflatable device) is inflated. The complete separation of the top end 32 of the first stringer 3 from the slider 19 has a further advantage that once the lifejacket has been deflated in preparation for subsequent use, the slider 19 is easily moved to the bottom end 13 of the second stringer 5, thereby making the slide fastener 1 reusable and speeding up the time it takes to recommission the lifejacket.

In this embodiment two coupling elements 15 have been removed or omitted from each of the stringers 3, 5. The invention is not limited to a gap of this number of coupling elements, and in other embodiments greater or fewer coupling elements 15 may be removed or omitted which will affect the ease with which the slide fastener bursts when a force is applied. The number of coupling elements to be removed can be readily determined by trial. Also, coupling elements may be removed or omitted from only one of the stringers.

In another embodiment, a lifejacket may have two or more weakened regions 23 in the form of gaps 25 along its length. In a further embodiment, a lifejacket may have no gaps 25 along its length, but the peeling action may begin at the top end, where the slider 19 is located, by forcing the first stringer 3 away from second stringer 5 and the slider 19.

Also, two slide fasteners 1 may be used. The bottom ends of the fasteners may be located respectively at the point A and B, and the upper ends of the fasteners positioned adjacent one another on the neck region of the life jacket cover, point C in FIG. 6.

FIG. 3 shows a slide fastener 1' according to a second embodiment of the invention. The slide fastener 1' has the same overall structure as the slide fastener 1 of FIG. 2. The difference between these two slide fasteners is that the slide fastener 1' of FIG. 3 does not have a gap 25 at the first position 23, unlike the slide fastener 1 of FIG. 2. Rather, in place of the gap 25 there are a number of modified coupling elements 30 which burst under a force in a direction perpendicular to the plane in which the tapes 4 lie. The structure of such modified coupling elements 30 is as described in greater detail in the applicant's corresponding UK application number 0414935.7, which is incorporated herein by reference, and as illustrated in FIGS. 4*a* and 4*b*, as described below.

The moulded plastics elements in standard (unmodified) form have a body which is moulded onto an edge of a fastener tape, a neck extending from the body and a head on the outer end of the neck. The neck forms a narrow or waisted region between the head and body. The head of a coupling element fits between the necks of two adjacent coupling elements on the opposite fastener tape to prevent separation of the coupled elements in the plane of the elements. A shoulder is provided adjacent the element neck and cooperates with a groove in the head of an opposed element to limit out of plane movement of the fastener heads.

FIGS. 4*a* and 4*b* show modified moulded coupling elements 30. The upper body head 38 of the modified coupling element 30 will rest on the shoulder 46 of an adjacent element 30, thus resisting any inward force (that is downwards as seen in FIG. 4*a*). However, the nose 44 passes between the shoulders 46 of the opposite coupling elements 30, and so there is less resistance to an outward force (upwards as seen in FIG. 4*a*). Also, the nose portion 44 will not engage an opposed coupling element 30. The nose 44 sits between the shoulders 46 and limits the flexing of the slide fastener chain if it is curled or rolled up, about a line in the fastener plane transverse to the coupling elements 15, 30.

Thus the line of engaged elements can be flexed more easily, in one direction only, at the modified coupling elements 30, providing a point of weakness at which the zip fastener can be peeled open while maintaining a uniform appearance for the slide fastener 1' when viewed from one direction. Also, the slide fastener 1' can be opened and closed in the normal manner using a slider.

In an alternative embodiment, the head 38 is shaped like the nose 44. Such coupling elements would flex equally easily in both directions.

The number of modified elements 30 to be used will depend on the desired force to be applied to open the fastener. Preferably a run of at least 3 adjacent elements is provided, one on one tape 4, and two on the other tape 4, and more preferably at least 4 elements 30.

The modified coupling elements 30 may also be provided in combination with a gap 25 in the elements. Thus, a gap 25 is formed by omitting or removing elements 15 as in the embodiment of FIG. 2, and the elements immediately adjacent the ends of the gap 25, on one or both tapes 4, are modified elements 30.

FIGS. 16 and 18 show slide fasteners 1", 1"" according to further embodiments of this invention. The slide fasteners 1", 1"" have the same overall structure as the slide fastener 1 of FIG. 2. The difference between the two slide fasteners 1", 1"" and the slide fastener 1 of FIG. 2 is that the slide fasteners 1", 1"" of FIGS. 16 and 18 have guide elements 33, 33' and transition elements 34 in addition to the coupling elements 15 which run along the bulk of the edges 17 of the tapes 4.

In particular, the slide fastener 1" of FIG. 16 has guide elements 33 at the first position 23 running along the edges 17 of the tapes 4 (where there is a gap 25 in the coupling elements 15 in FIG. 2) and at the top end 24 of the coupling elements 15 distal to the insert pin 7 (where there are no coupling elements at the top end 24 of the coupling elements in FIG. 2); and a transition element 34 between the lowest of the guide elements 33 and the coupling elements 15 on each tape 4 at each of the positions 23, 24, as is explained below.

Unlike the coupling elements 15 described above in relation to FIG. 3, the guide elements 33 of FIG. 16 have no neck or head, i.e., they are comprised only of a body having a rectangular shape in plan view. As the guide elements 33 have no neck or head, guide elements 33 cannot be engaged with opposed guide elements 33 or coupling elements 15. In the embodiment of FIG. 16 there are 12 guide elements 33 on the first stringer 3 and 13 opposed guide elements 33 on the second stringer 5.

The slide fastener 1"" of FIG. 18 has guide elements 33' having a triangular head 39 so that opposed guide elements 33' fit between each other without engaging with each other. An advantage of these guide elements 33' over the guide elements 33 of FIG. 16 is that the gap between opposed elements 33' is reduced, thereby impeding insertion of objects, such as fingers, between opposed elements 33', which may lead to injury or premature opening of the slide fastener at the first position 23. Also, during the manufacturing process the guide elements will help prevent false detection of a gap in a run of elements, which is usually used to detect the end of a chain or stringer to signal an operation to cut the tape, for example.

The purpose of these guide elements 33, 33' is to guide the slider 19 as it is moved along those portions of the slide fastener 1", 1"" where the tapes 4 do not engage. When the slider 19 is moved along the slide fastener 1", 1"" from the coupling elements 15 below the first position 23 to the coupling elements 15 above the first position 23, the slider 19 does not become derailed from the tapes 4 as it is moved through this first position 23 and easily re-engages with the coupling elements 15 above the first position 23. This is particularly advantageous where the first position 23 extends over a large number of guide elements 33, 33', as shown in FIGS. 16 and 18; if these guide elements 33, 33' were not present there is a risk that the slider 19 would derail from the tapes 4 or that it would be difficult to align the opposed coupling elements 15 which are immediately above the first position 23.

In the embodiments of FIGS. 16 and 18, there are rectangular guide elements 33 on each of the tapes 4 at the top 24 of the string of coupling elements 15, in the region of the end stop 21. There is one guide element 28 (33) at the top of the first stringer 3 and two opposed guide elements 33 at the top of the second stringer 5. Preferably, the location of the guide element 33 at the top of the first stringer 3 is such that when the slider 19 is at its uppermost position on the second stringer 5, abutting the end stop 21, part of the top guide element 28 on the first stringer 3 is disposed in the slider 19.

As in the first embodiment of FIG. 2, the presence of this top guide element 28 in the slider 19 prevents separation of the stringers 3, 5 at this position when the slide fastener 1", 1"" is closed with the slider 19 abutting the end stop 21. This arrangement does not, however, prevent separation of the stringers 3, 5 when the slide fastener 1", 1"" bursts open, and may also provide a weakened region for bursting of the slide fastener 1", 1"" as is explained above in relation to FIG. 2. Furthermore, using guide elements 33 at the top end 24 of the stringers 3, 5 in place of coupling elements 15 makes it easier for the first stringer 3 to be released from the slider 19, as opposed guide elements 33 on the stringers 3, 5 do not engage with each other, hence, there is less resistance to movement of the first stringer 3 out of the slider 19 than there would be if coupling elements 15 are used.

In FIG. 16 there are transition elements 34 at two positions along the length of the slide fastener 1", namely between the lowest of the guide elements 33 and the coupling elements 15 on each tape 4 at each of the first position 23 and the top end 24 of the coupling elements 15. In FIG. 18 there are only transition elements 34 at the top end 24 of the coupling elements 15.

A conventional slider 19 is made up of an upper blade (on which mounting posts are located) and a lower blade, which are connected by a guide post. Guide flanges extend from each of the longitudinal edges of the upper and lower blades to define guide channels between the guide flanges and the guide post. The dimensions of the guide channels are matched to the dimensions of the coupling elements; the cross sectional area of a guide channels is such that coupling elements fit snugly therein, as is well known in the art.

For a conventional slide fastener, the portion of the stringers in the slider defines a Y-shape, i.e., the stringers are engaged below the slider and disengaged above the slider. As the slider is moved down the stringers, the engaged coupling elements entering the slider are disengaged as the stringers are drawn into the guide channels and beyond the guide post.

As mentioned above, the difference between the rectangular guide elements 33 and the coupling elements 15 is that the coupling elements 15 have a neck and a head, whereas guide elements 33 only have a body. This means that rectangular guide elements 33 are shorter than coupling elements 15 in a direction extending outwards from the edge 17 of the tape 4, and that there is ample space to accommodate these guide elements 33 in the guide channels of a slider. For a slide fastener having guide elements 33 as described above, when the slider 19 moves downwards along these guide elements 33 the angle between the stringers above the slider is likely to be less than the angle between the stringers when the slider moves along coupling elements 15. This reduced angle means that the coupling elements 15 approaching the guide post from below are less pealed apart than they would be if there were coupling elements 15 in the guide channels adjacent to the guide post. Therefore, when the slider is moved downwards from the guide elements 33 to the coupling elements 15 therebelow, the guide post of the slider may not clear the end of the coupling element 15 and may become caught in the neck of the coupling element 15 immediately below the guide elements 33, which prevents the slider from being pulled further down the slide fastener.

In order to prevent this fouling of the slider 19 on the coupling elements 15, there are transition elements 34 on the slide fasteners 1", 1"" of FIGS. 16 and 18, which enable smooth downward movement of the slider along the slide fastener 1", 1"". There is a transition element 34 on each stringer 3, 5 at the top end 24 of the tape 4 between the bottom guide element 33, 33' and the top coupling elements 15 on the slide fasteners 1", 1"" of FIGS. 16 and 18, and a further transition element 34 on each stringer 3, 5 at the first position 23 between the bottom guide element 33 and the top coupling elements 15 on the slide fastener 1" of FIG. 16. The transition elements provide a cam surface facing the slider guide post, over which the guide post can slide to prevent fouling of the guide post on the element.

As can be seen from FIG. 17 and FIGS. 17*a*-17*d*, the transition elements 34 have no projections on the side 35 which faces the top end 24 of the slide fastener 1", 1"", and present a generally convex surface towards the guide post so that when the slider 19 is moved down the slide fastener 1", 1"" the guide post of the slider 19 will come into contact with the side 35 of the transition element 34 which faces the top end 24 of the slide fastener 1", 1"" and will push the transition element 34 outwards to pass the transition element 34. Hence, the slider 19 is not caught on the transition elements 34 and the slider 19 can easily be pushed beyond the transition elements 34 to facilitate continuous disengagement of the slide fastener 1", 1"".

Preferably, the end portion 37 of the side 35 which faces the top end 24 of the slide fastener 1", 1"" is angled downwards, away from the top end 24 of the slide fastener 1", 1"", to give the side a convex shape as shown in FIG. 17, to ease passage of the guide post of the slider 19 past the transition element 34, to encourage separation of the stringers 3, 5 at this point.

The shape of the transition elements can be varied to suit the adjacent coupling elements and the transition elements on opposed tapes need not be identical In the slide fastener 1"" of FIG. 18, there are no transition elements 34 at the at the first position 23 between the bottom guide element 33' and the top coupling elements 15 as the triangular shape of the head 39 of the lowest guide elements 33' provides a sloped surface for the guide post of the slider 19 to push against to push the guide elements 33' apart so that the slider 19 can easily be pushed beyond the guide elements 33' to facilitate continuous disengagement of the slide fastener 1"".

In other embodiments there may be guide elements 33, 33' and/or transition elements 34 at only one of the first position 23 and the top end 24 of the tape 4. For example, transition elements 34 may be mounted on the slide fastener 1 of FIG. 2 on each of the stringers 3, 5 in place of the coupling elements 15 which are immediately below the gap 25.

The slide fasteners 1", 1"" of FIGS. 16 and 18, and any of the other embodiments described above having guide elements 33 and/or transition elements 34, can be attached to the lifejacket 101' in place of the slide fastener 1 of FIG. 2.

When the slide fastener 1, 1', 1", 1"" of FIG. 2, 3, 16 or 18 is closed, and before the lifejacket has been inflated, there is the possibility that the slide fastener 1, 1', 1", 1"" will begin to peel open due to rough handling in normal use.

According to a further embodiment as shown in FIG. 5, a reinforcement such as flap 51 may be placed over the gap 25 of the slide fastener 1 of FIG. 2, over the modified elements 30 of the slide fastener 1' of FIG. 3 or over the first position 23 of the slide fastener 1", 1'" of FIGS. 16 and 18. This flap 51 helps to impede premature bursting of the slide fastener by increasing the force required to disengage the elements adjacent the modified or missing elements and by protecting this area from fouling by other objects which may lead to premature bursting. Similarly, a flap 53 may be placed at the top end of the slide fastener 1 to prevent premature bursting of the slide fastener where the slider 29 is located. These flaps 51, 53 may be attached by use of a hook-and-loop surface fastener to each of the tapes 4 as shown in FIG. 5. In another embodiment, the tapes 51, 53 may be attached to the front and back panels 107, 109 of the lifejacket 101', laying across the slide fastener 1, 1', 1", 1'" at the region 26 or the slider 19 when in the closed position, to inhibit separation of the slide fastener 1, 1', 1", 1'" at this point. When the tube 105 inflates, the expansion of the tube overcomes the resistance of the hook and loop fastener as well as bursting the slide fastener at the weakened region 26 and/or slider 19. Alternatively, other types of reinforcement such as a frangible or uncouplable link as described in EP-1468622-A may be used. Such links include a link formed by partially melting adjacent areas of the stringer tapes 4, to join the stringer tapes 4; a link comprising a piece of tape such as taffeta tape, by gluing, sewing or welding to bridge the gap between the stringer tapes 4; a link comprising a snap fastener having interlocking first and second parts, e.g. male and female parts, where the direction of engagement of the parts is either in the plane in which the tapes lie or perpendicular thereto. Alternatively, adhesive tape may be used to cover these portions. Preferably the reinforcement should be reusable.

In this embodiment the shape of the heads of the elements is different on each side of the slide fastener 1"". FIG. 20 is a rear view of the slide fastener 1"", where the rear portion of the heads of the locking elements 41 has a head and neck similar to the shape of coupling element 15, so that opposed locking elements 41 can be engaged. As can be seen from FIG. 19, the front of the locking element 41 has a triangular shape, similar to the shape of guide elements 33'. These front portions of the heads of the locking element 41 do not interengage. The heads of the locking element 41 have different front and rear portions to prevent out-of-plane disengagement of the locking element 41. In other embodiments both the front and rear portions of the heads of the locking element may be of the same engaging type, the locking element also comprising shoulders to prevent out-of-plane disengagement.

To engage opposed locking elements 41 a force must be applied to each locking element 41 sufficient to bend the locking elements 41 to allow insertion of the heads of opposed elements between the heads of the locking element 41. Similarly, to disengage opposed locking elements 41, each locking element must be bent to allow the head of an opposed element to be removed from between the heads of the locking element 41.

For the slide fastener 1"" of FIGS. 19 and 20, the locking element 41 can be closed and opened in the normal manner by moving the slider 19 along the elements of the tapes 3, 5 when closing and opening the slider fastener 1"", although an increased force is required to close and open the locking elements 41. When the slide fastener of FIGS. 19 and 20 is closed as shown in these Figures, it can be burst open by applying a force to the first position 23 which is sufficiently strong to disengage the locking elements 41. In this manner, the slide fastener 1"" of FIGS. 19 and 20 can resist premature opening of the slide fastener.

FIG. 7 shows a life raft 151 having a clamshell type cover 153 formed of two halves 155, 157 joined by a slide fastener 1-1"" of the embodiments of FIG. 2, 3, 5 or 15 to 20. A reinforcement 51 is attached to the cover halves 155, 157, to reinforce a weakened region 26 (hidden from view) in the fastener 1-1"". When the life raft 11 is thrown into water, the life raft inflates automatically, to undo or break the reinforcement 151 and burst the zip fastener 1-1"" at the weakened region 26.

FIG. 8 shows a temporary end stop 61 for the slide fastener of FIG. 2, 3, 5 or 16. The temporary end stop 61 has pins 63 which extend outwards from the tape 4 to impede the slider 19 from moving further up the coupling elements 15 of the slide fastener 1, 1', 1". The pins 63 project above and below the tape 4. The pins 63 are arranged such that the slider 19 moves past the pins 63 if an increased force is applied to the slider 19. In use, the slider fastener 1, 1', 1" is closed as normal by moving the slider 19 from the bottom 9, 13 of the slide fastener 1, 1', 1" towards the top end 29 of the slide fastener 1, 1', 1" to its uppermost position below the pins 63. When the device is inflated, the slide fastener 1, 1', 1" peels apart from the gap 25 or modified coupling elements 40 and when the opening of the slider fastener 1, 1', 1" reaches the slider 19, the force of the inflating tube pushes the slider 19 past the pins 63 so that the slider 19 travels to the end stop 21 at the top of the chain of coupling elements 15 on the second stringer 5, and the first stringer 3 disengages from the slider 19, thereby opening the slide fastener 1, 1', 1" fully along its length. Other temporary end stops may be used, such as a deformable end stop, as is known in the art. A temporary end stop can be additionally or alternatively mounted on the second stringer at a similar position to the temporary end stop 61 shown in FIG. 8 and would have the same effect.

FIG. 9 shows locking elements 67 which can be fitted towards the upper end of the chain of coupling elements 15. The locking elements 67 are fitted below the top of the chain of coupling elements 15, i.e., there are coupling elements 15 above the locking elements 67.

In use, when the slider 19 is moved along the chain of coupling elements 15 towards the top end 29 of the slide fastener 1, 1', 1" the slider 19 passes over the locking elements 67, thereby engaging the locking elements 67, and passes to the top of the chain of engaging elements 15 to its uppermost position by end stop 21. At this position the slider 19 is no longer engaged with the first stringer 3 and the locking elements 67 hold the top 29 of the stringers 3, 5 together. When the slide fastener 1, 1', 1" bursts, the coupling elements 15 disengage towards the locking elements 67, forcing the locking elements 67 apart, and the slider fastener opens fully along its length.

FIGS. 10 and 11 show modified insert pins 7', 7" which are fitted at the lower end 9 of the first stringer 3. The insert pin 7', 7" is modified so that when the slide fastener 1, 1', 1" bursts along its length and the opening in the slide fastener 1, 1', 1" reaches the bottom 9 of the slide fastener 1, 1', 1", the insert pin 7', 7" detaches easily from the retaining box 11.

The insert pin 7' of FIG. 10 has a rounded lower outer corner 69 and a cut out inner edge 71, i.e. the edge which faces the tape 4 of the first stringer 3. When the slide fastener 1, 1', 1" bursts, a top end 73 of the insert pin 7 moves away from the box pin 75 which is attached to the retaining box 11, i.e., the top 73 of the insert pin 7 moves to the left, and the curved lower outer corner 69 in combination with the cut out 71 allow the insert pin 7' to move out of the retaining box 11 easily.

In FIG. 11, the insert pin 7" is shorter than the insert pin 7' of FIG. 10 and this shortening has a similar effect to the rounding of the lower outer corner 69 of the insert pin of FIG. 10, i.e., when the slide fastener 1, 1', 1" bursts the insert pin 7" comes out of the retaining box 11 easily.

FIG. 15 is a schematic cross sectional view of a second type of slide fastener 1'" according to a further embodiment of the invention. The slide fastener 1''' is comprised of interlocking male 201 and female 203 members which extend continuously out of the page. The male member 201 has an arrow-shaped head 205. The head 207 of the female member 203 has a rectangular profile, with an opening 209 in the centre of the outer wall 211 which faces the male member 201. The height h of the opening 209 is less than the height H of the arrow-shaped head 205 of the male member 201. The head 205 of the male member 201 and/or the outer wall 211 are resiliently deformable so that the arrow-shaped head 205 can be inserted through the opening 209 into the cavity 213 of the head 207 of the female member 203. The head 205 of the male member 201 is prevented from exiting the cavity 213 by the outer wall 211.

The slide fastener 1''' is closed using a slider (not shown) which moves along the male 201 and female 203 members. When the slider moves along the members 201, 203 in one direction it pushes the arrow-shaped head 205 of the male member 201 through the opening 209 into the head 207 of the female member 203 to engage the male 201 and female 203 members, and as the slider moves in the other direction is disengages the members 201, 203 by easing the arrow-shaped head 205 through the opening 209 outwards.

The slide fastener 1''' according to this embodiment of the invention is modified at a first position so that the arrow-shaped head 205 can be pulled out of the female member 203. The slide fastener 1''' is modified by reducing the height H of the head 205 and/or by increasing the height h of the opening 209. Such modifications may be made at more than one position along the slide fastener 1'''. The slide fastener 1''' is modified at a second position such that the height of one of the male 201 or female 203 members is reduced so that the slider disengages from the male 201 or female 203 member respectively. Other slide fasteners having continuously extending members may be used, for example, a slide fastener having a male member with a double head and a female member with a head having an 8-shaped profile with openings in the inner wall and an outer wall.

The slide fasteners 1-1'''' described above are ideally suited for inflatable devices such as the lifejacket 101' of FIG. 6 or the liferaft 151 of FIG. 7. In addition to the slide fasteners 1-1'''' being used on inflatable devices, they can also be used in other applications such as on tent openings (FIG. 12), to join partition walls (FIG. 13), on sleeping bags (FIG. 14) and on other apparatus which have a join which may on occasion need to be burst open.

It will be appreciated by the person skilled in the art that the use and configuration of modified coupling elements 40, gaps 15, flaps 51, 53 and end stops 63 will depend on a number of factors including the application, the type, size and material from which the slide fastener is made, the force applied to burst the slide fastener etc., and that the skilled person will be able to determine a configuration suitable for each application, to provide a balance between ensuring that the fastener bursts when required but does not open prematurely.

Various modifications will be apparent to those in the art and it is desired to include all such modifications as fall within the scope of the accompanying claims.

The invention claimed is:

1. A slide fastener comprising:

a first stringer, a second stringer, a slider, and an end stop, each stringer being comprised of a tape as well as coupling elements and one or more transition element mounted on an edge of said tape, the one or more transition element being disposed at a top end of a row of the coupling elements, the slider being slidably mounted on said second stringer and slidable along the coupling elements of said first and second stringers to engage said coupling elements as it moves from a bottom of said slide fastener to a top of said slide fastener, wherein when the slider is at its uppermost position on the second stringer, the slider abuts the end stop, a side of the one or more transition element which faces the top of the slide fastener presenting a surface to said slider to deflect the slide fastener transition element away from a guide post of said slider as said slider comes into contact with the slide fastener transition element when said slider is moved down the slide fastener; and wherein the transition element comprises a body portion mounted on the edge of said tape and a neck portion extending from the body portion away from the tape, wherein the side of the transition element that faces the top of said slide fastener comprises a surface of the body portion and a surface of the neck portion with the neck portion being offset downwardly from the surface of the body portion.

2. The slide fastener of claim 1, wherein the side of the transition element which faces the top includes a portion that is angled downwards, away from the top of said slide fastener.

3. The slide fastener of claim 2, wherein the side of the transition element which faces the top of the slide fastener has a convex shape.

4. The slide fastener of claim 1, wherein the side of the transition element which faces the top of the slide fastener has a convex shape.

5. The slide fastener of claim 1, wherein the side of the transition element which faces the top of said slide fastener has no projections.

* * * * *